US008029092B2

(12) United States Patent
Yoda et al.

(10) Patent No.: US 8,029,092 B2
(45) Date of Patent: Oct. 4, 2011

(54) PRINTING APPARATUS

(75) Inventors: Kaneo Yoda, Okaya (JP); Hiroshi Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 501 days.

(21) Appl. No.: 12/203,775

(22) Filed: Sep. 3, 2008

(65) Prior Publication Data

US 2009/0073221 A1 Mar. 19, 2009

(30) Foreign Application Priority Data

May 1, 2007 (JP) ..... 2007-120562

(51) Int. Cl.
*B41J 2/165* (2006.01)

(52) U.S. Cl. ..... 347/33

(58) Field of Classification Search ..... 347/9, 22, 347/23, 33

See application file for complete search history.

(56) References Cited

U.S. PATENT DOCUMENTS 7,114,793 B2 * 10/2006 Katsuta et al. ..... 347/22

FOREIGN PATENT DOCUMENTS

JP 2005-096116 4/2005

* cited by examiner

*Primary Examiner* — An Do

(74) *Attorney, Agent, or Firm* — Workman Nydegger

(57) ABSTRACT

The invention prevents and suppresses wasteful expenditure of ink which occurs when recovering nozzles. In greater detail, a plurality of head units arranged in a direction which intersects a transportation direction of a printing medium is provided, a plurality of cleaning units is disposed to face the plurality of head units, and at least one of the plurality of cleaning units is selected and moved so as to be in close contact with the corresponding cleaning unit. By such a method, only the cleaning head unit which faces the head unit of which nozzles need to be recovered is selected and is brought into contact with the head unit, and liquid is sucked in from the nozzles of the head unit.

7 Claims, 9 Drawing Sheets

PRINTING APPARATUS

BACKGROUND OF THE INVENTION

1. Field of the Invention

The present invention relates to a printing apparatus which prints predetermined images or letters by forming dots on a print medium by ejecting liquid from a plurality of nozzles.

2. Description of the Related Art

With the wide spread of personal computers and digital cameras, ink-jet printers which are one kind of printing apparatus have been widely used by general users as well as office workers thanks to the advantage that they enable high quality color print copies to be attained at low cost.

Such an ink-jet printer forms fine dots on a print medium by ejecting (discharging) liquid-state ink droplets from nozzles of an ink-jet head while moving the print medium and the liquid ejecting head (also called ink-jet head) in relative to each other, and thus produces a desired print copy by forming predetermined letters or images on the print medium. A printer in which an ink-jet head is loaded on a moving unit called a carriage which is to move in a direction which intersects a transporting direction of the print medium is generally called a multi-pass ink-jet printer. On the other head, an ink-jet head (which is not necessarily an integrally-formed body) which is relatively long in a direction which intersects the transporting direction of the print medium and which can complete a print by only a single pass is called "line head-type ink-jet printer".

In such an ink-jet printer, sometimes ink droplets are not properly discharged from nozzles for some reasons; for example bubbles may invade into the nozzles, paper powder or ink crude may stick to the nozzles, ink in the nozzles may dry and a viscosity of the ink may increase. In such cases, ink in the nozzles must be sucked in by reducing the pressure inside the cap while a cap of a cleaning unit is in close contact with a nozzle-formed surface of the ink-jet head. In such a way, nozzles are recovered to be in a normal state. In an ink-jet printer disclosed in JP-A-2005-96116, nozzles are recovered to a normal state in a manner such that caps of cleaning units are simultaneously brought into close contact with the nozzle-formed surface of a line head ink-jet head which is long in a direction which intersects the transporting direction of the print medium and ink in the nozzles is sucked in. Further, a technique in which the nozzle-formed surface of the ink-jet head is wiped by a thin plate member made of rubber called wiper so that meniscus of the nozzles is regulated, and ink or paper powder attached the nozzle-formed surface is removed so that the nozzle-formed surface is recovered to a normal state is familiar.

[Patent Document 1] JP-A-2005-96116

SUMMARY OF THE INVENTION

Problems to be solved by the invention are as follows:

That is, as described in the patent document 1, the nozzles are recovered to a normal state in a manner such that the caps of the cleaning units are simultaneously brought into close contact with the entire nozzle-formed surfaces of the line head ink-jet heads which are relatively long in a direction which intersects the transporting direction of the print medium, and the ink in the nozzles are sucked in the contact state. Accordingly, this technique has a problem in that ink is wasted.

The invention is made in view of the above-mentioned problems, and an object of the invention is to provide a printing apparatus which can prevent and suppress wasteful expenditure of ink on the front and rear sides of the nozzles, and Accordingly, the following inventions are provided in order to solve the above-mentioned problems.

The printing apparatus according to one aspect of the invention includes a printing apparatus including a plurality of liquid ejecting head units divisionally disposed in a direction which intersects a transporting direction of a print medium, a plurality of cleaning units disposed to face the plurality of liquid ejecting head units, respectively, and a moving unit which selects at least one cleaning unit of the plurality of cleaning units and moves the selected cleaning unit toward the liquid ejecting head unit which faces the selected cleaning unit.

According to this invention, only the cleaning unit which faces the liquid ejecting head unit of which a nozzle-formed surface needs recovering is selectively brought into contact with the liquid ejecting head unit and therefore only the liquid in and around the nozzles of the liquid ejecting head unit is sucked in. Accordingly, it is possible to suppress wasteful consumption of liquid.

The printing apparatus is characterized in that the cleaning unit be equipped with a wiper which wipes the nozzle-formed surface of the corresponding liquid ejecting head unit, and the printing apparatus further includes a second moving unit which moves the wiper along the nozzle-formed surface of the corresponding liquid ejecting head unit in a state in which the wiper abuts against the corresponding liquid ejecting head unit.

According to this invention, it is possible to prevent the nozzle-formed surfaces of the liquid ejecting head units, which do not need recovering, from deteriorating by selecting only the cleaning units which face the liquid ejecting head units of which the nozzle-formed surfaces need recovering and bring wipers of the corresponding cleaning units into contact with the nozzle-formed surfaces of the liquid ejecting head units which need recovering.

The printing apparatus is characterized in that each of the cleaning units be equipped with a cap which covers the nozzle-formed surface of the corresponding liquid ejecting head unit which faces the cleaning unit, and the printing apparatus further includes a suction unit which sucks in liquid from nozzles of the corresponding liquid ejecting head unit in a state in which the cap is in close contact with the nozzle-formed surface of the corresponding liquid ejecting head unit.

According to the invention, only the cleaning unit which faces the liquid ejecting head unit of which the nozzle-formed surface needs recovering is selected and the cap of the selected cleaning unit is brought into contact with the corresponding liquid ejecting head unit, and the liquid in and around the nozzles of the liquid ejecting head unit is sucked. For such a reason, it is possible to prevent the liquid from being wasted. Further, since the cap of the cleaning unit is in close contact with the nozzle-formed surface of the liquid ejecting head unit while the liquid ejecting head unit is not used, it is possible to prevent the liquid in the nozzles of the liquid ejecting head unit from being dried off.

The printing apparatus is characterized in that the first moving unit be constituted by a plurality of cams disposed corresponding to the plurality of cleaning units, and the plurality of cams be attached to a rotation shaft of a single actuator.

According to this invention, since the phases of the cam noses of the cams attached to the rotation shaft of the single actuator are different from one another, it is possible to selectively move at least one of the cleaning units in contact with the cams so that the selected cleaning unit is brought into contact with the nozzle-formed surface of the liquid ejecting head unit which faces the corresponding cleaning unit. Further, if necessary, it is possible to synchronously move a plurality of cleaning units so that the cleaning units are brought into contact with the corresponding liquid ejecting head units, respectively. Still further, with such a structure, it is possible to reduce the total number of actuators.

The printing apparatus is characterized in that phases of cam noses of the plurality of cams attached to the rotation shaft of the single actuator be different from one another.

According to this invention, any one of the cleaning units or several cleaning units of the plurality of cleaning units can be selectively moved so as to be brought into contact with the nozzle-formed surfaces of the corresponding liquid ejecting head units, respectively.

BRIEF DESCRIPTION OF THE DRAWINGS

The following description and the accompanying drawings will be referenced to better understand the invention and advantages of the invention.

DETAILED DESCRIPTION OF PREFERRED EMBODIMENTS

Next, embodiments of the invention will be described with reference to the accompanying drawings while exemplifying an ink-jet printer which prints letters or images to a print medium by discharging ink as a printing apparatus.

Figure 1:
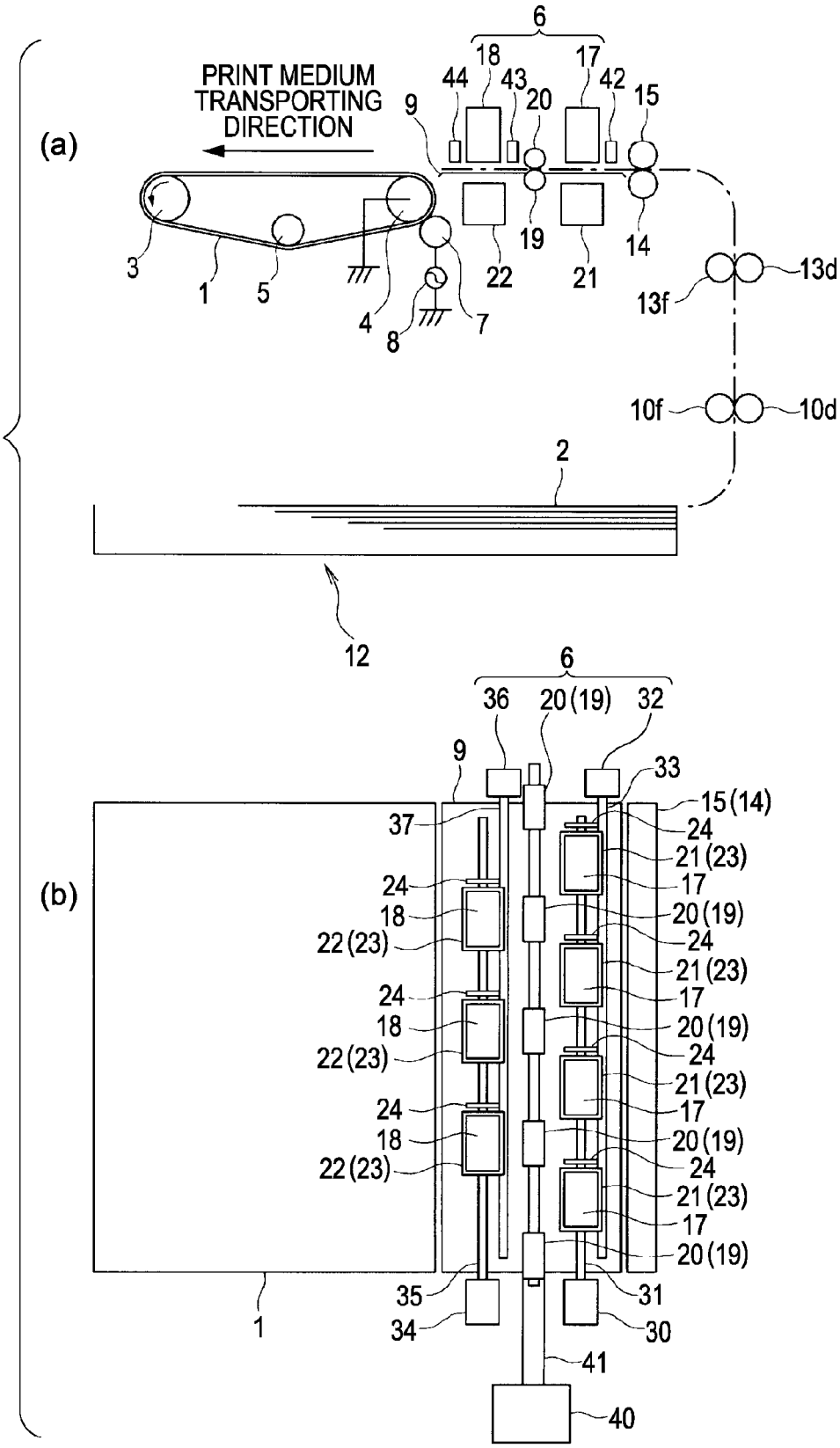
FIG. 1 is a view illustrating an overall structure of a line head ink-jet printer according to a first embodiment of the invention, in which (a) is a plan view and (b) is a front view.

FIG. 1 is an overall view illustrating an ink-jet printer according to this embodiment of the invention overall. FIG. 1*a* is a front view and FIG. 1*b* is a plan view of the ink-jet printer according to this embodiment of the invention. Numeral 6 of the drawing denotes an ink-jet head unit group serving as a liquid ejecting head which ejects (discharges) liquid in a swirl shape. Numeral 1 of the drawing is an endless transporting belt for transporting the print medium 2, such as print paper at a downstream side of the transporting direction of the print medium 2 of the ink-jet head unit group 6. The transporting belt 1 is wound around a driving roller 3 disposed on the left end portion of the figure, a driven roller 4 disposed at the right end portion of the figure, and a tension roller 5 disposed under a midway of the driving roller 3 and the driven roller 4. The driving roller 3 is rotated in the direction of an arrow of the figure by a transporting motor (not shown) and transports the print medium 2 in the direction of an arrow (i.e. from right side to left side) in a state in which the print medium 2 is adsorbed to the transporting belt 1 charged by a charging roller by electrostatic adsorption. The transporting belt 1 is interposed between the driven roller 4 and a contact portion of the charging roller and the driven roller 4 is grounded to apply a voltage. The tension roller 5 is disposed inside the transporting belt 1 and is urged downward by a tension applying mechanism (not shown). With such a structure, tension is generated by the transporting belt 1.

The transporting belt 1 is in contact with the charging roller 7 serving as a charging unit while facing the driven roller 4. The charging roller 7 is connected to an alternate current (AC) power source 8 of about 10 to 50 Hz. The charging roller 7 is disposed at a position right in front of a print medium feeding position where the print medium 2 is fed to the transporting belt 1. The charging roller 7 electrically charges the transporting belt 1 composed of a medium•high resistive element by supplying charges to the surface of the transporting belt 1. Such charging causes dielectric polarization to occur at the print medium 2. As a result, the print medium 2 is adsorbed to the surface of the transporting belt 1 by electrostatic force attributable to charges of the print medium attributable to dielectric polarization and charges of a dielectric portion of the surface of the transporting belt 1. The charging roller 7 is pressed against the transporting belt 1 by a spring (not shown).

Figure 2:
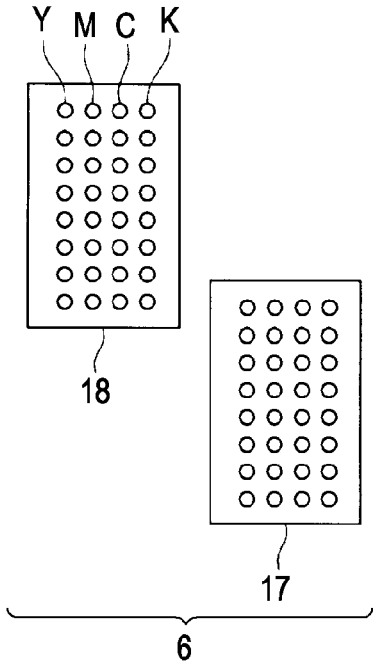
FIG. 2 is an explanatory view for explaining the structure of an ink-jet head unit group of the ink-jet printer of FIG. 1.

The ink-jet head unit group 6 includes relatively small-sized head units 17 and 18, each having a length of about 30 to 40 millimeters in a direction which intersects the print medium transporting direction as shown in FIG. 2. The head units 17 and 18 are arranged in a zigzag form in a plan view. Each of the head units 17 and 18 has four-color nozzle columns including yellow (Y), magenta (M), cyan (C), and black (K) nozzle columns. The nozzle columns are disposed to be shifted from one another. Nozzles at an end portion of each of the nozzle columns of each of the head units 17 and 18 in a direction which intersects the print medium transporting direction are disposed to overlap nozzles at an end portion of each of the nozzle columns of an adjacent head unit 17 or 18, which are arranged in a zigzag form, in the print medium transporting direction. In such a manner, fine ink dots are formed on the print medium 2 by simultaneously discharging ink droplets from these nozzles at desired positions by desired amount. By performing such operation for every color, it is possible to perform single-pass printing by letting the print medium 2 adsorbed to the transporting belt 1 pass through underneath the head unit group. That is, an installation area of the ink-jet head unit group 6 (head units 17 and 18) corresponds to a print area. Of the head units 17 and 18 arranged in a zigzag form, a head unit 17 disposed at an upstream side in the print medium transporting direction is referred to as an upstream side head unit 17, and a head unit 18 disposed at a downstream side in the print medium transporting direction is referred to as a downstream side head unit 18. A first print medium sensor 42 is disposed on the upstream side of the upstream side head unit 17 in the print medium transporting direction, a second print medium sensor 43 is disposed on the upstream side of the downstream side head unit 18 in the print medium transporting direction, and a third print medium sensor 44 is disposed on the downstream side of the downstream side head unit 18 in the print medium transporting direction. Each of these print medium sensors 42 to 44 is an optical sensor and detects whether the print medium 2 is present right under the sensor.

As methods of discharging ink from each of nozzles of the ink-jet head (head unit), known methods include an electrostatic method, a piezo-electric method, and a film boiling ink-jet method. According to the electrostatic method, ink is discharged in a manner such that when a driving pulse signal is applied to an electrostatic cap serving as an actuator, an inside pressure of a cavity changes as a vibrating plate disposed inside the cavity is displaced, and ink droplets are discharged by the pressure change. According to the piezo-electric method, ink is discharged in a manner such that when a driving signal is applied to a piezo-electric element serving as an actuator, an inside pressure of a cavity change as a vibrating plate inside the cavity is displaced, and therefore ink droplets are discharged from nozzles according to the pressure change. According to the film boiling ink-jet method, a small heater is provided inside a cavity, ink falls into a film boiling state as the ink is instantaneously heated to 300° C. As a result, air bubbles are generated, resulting in the pressure change. Therefore, ink droplets are discharged from the nozzles by the pressure change. The invention can be applied to any of the ink discharge methods.

The print media 2 before paper feeding are stored in a paper feeding portion 12, auxiliary rollers 10*d* and 10*f* and feeding rollers 13*d* and 13*f* which feed the print media 2 stored in the paper feeding portion 12 are provided at a front side of the paper medium transporting direction of the paper feeding portion 12. A sending roller 14 and a pressing roller 15 are provided at a front side in the paper medium transporting direction of the feeding rollers 13*d* and 13*f*. The sending roller 14 and the pressing roller 15 correct a posture of the print medium 2 bumped thereto by the feeding rollers 13*d* and 13*f*, adjusts transporting timing of the print medium 2, and transport the print medium 2 to a print area, i.e. to a position under the ink-jet head unit group 6 (head units 17 and 18) at the transporting timing. Further, urethane or ceramic particles may be coated on the surface of the sending roller 14 in order to increase transporting force of the print medium 2 by increasing frictional coefficient.

A panel-shaped plane regulating body 9 called platen is placed in a midway position between rollers (the sending roller 14 and pressing roller 15) and the transporting belt 1 and under the ink-jet head unit group 6 (head units 17 and 18)). The plane regulating body 9 regulates flatness of the print medium 2 transported to the print area which is disposed under the ink-jet head unit group 6 (head units 17 and 18) as its name means. In the line head-type ink-jet head unit group 6 according to this embodiment, what is must be considered is to discharge ink droplets to at a predetermined position and to maintain the gap between the head unit group and the print medium 2. The plane regulating body 9 is provided with a penetration hole (not shown) which lets the cleaning unit pass therethrough and which lets ink droplets discharged from the ink-jet head unit group 6 (head units 17 and 18) pass therethrough so that the cleaning unit receives the ink droplets.

With this embodiment, an intermediate roller 19 and an intermediate pressing roller 20 serving as an intermediate transporting unit are provided between the upstream side head unit 17 and the downstream side head unit 18 which constitute the ink-jet head unit group 6. The intermediate roller 19 is provided under a print medium transporting line and the intermediate pressing roller 20 is provided above the print medium transporting line. The intermediate roller 19 and the intermediate pressing roller 20 transport the print medium 2 while interposing the print medium 2 between them in a similar manner with the sending roller 14 and the pressing roller 15. The intermediate roller 19 and the intermediate pressing roller 20 are provided in a midway position in a way from the upstream side head unit 17 to the downstream side head unit 18 in order to regulate the flatness of the print medium 2 under the downstream side head unit 18 and to maintain the gap between the downstream side head unit 18 and the print medium 2. The intermediate pressing roller 20 in contact with the print surface of the print medium 2 on which printing has just been finished by the upstream side head unit 17 is provided between neighboring upstream side head units 17. The intermediate roller 19 which pinches the print medium 2 together with the intermediate pressing roller 20 may be also provided between neighboring upstream side head units 17. This structure is configured to prevent ink from being attached to the intermediate pressing roller 20 in contact with the print surface 2 of the print medium 2 on which printing has been finished by the upstream side head unit 17.

According to the ink-jet printer, a sheet of the print medium 2 is taken out from the paper feeding portion 12 by the auxiliary rollers 10*d* and 10*f*, delivered to the feeding rollers 13*d* and 13*f*, and supplied to a nip portion of the transporting roller 14 and the pressing roller 15. If the print medium 2 is moved forward by a predetermined amount by the feeding rollers 13*d* and 13*f* even after the front end of the print medium 2 in the transporting direction is in contact with the nip portion of the transporting roller 14 and the pressing roller 15, the print medium 2 is flexed. After the flexure of the print medium 2 occurs, if the transporting force i.e. pinching force of the print medium 2 generated by the feeding rollers 13*d* and 13*f* is removed, a posture of the print medium 2 is corrected in a state in which the front end of the print medium 2 in transporting direction bumps into the nip portion of the transporting roller 14 and the pressing roller 15.

After the posture of the print medium 2 is corrected, the print medium 2 is supplied to a position above the plane regulating body 9 by the rotations of the transporting roller 14 and the pressing roller 15. Since the position above the plane regulating body 9 disposed at an upstream side of the print medium transporting direction is the print area disposed under the upstream side head unit 17, printing on the print medium 2 is performed by discharging ink droplets from desired nozzles of the upstream side head unit 17. At this time, even if frameless printing is performed, ink droplets discharged outside the print medium 2 are received in the cleaning unit through the penetration hole of the plane regulating body 9. Accordingly, ink is not attached to the upper surface of the plane regulating body 9 and the surface of the print medium 2 which is opposite to the print surface, so those surfaces are not polluted.

The print medium 2 on which printing has been performed by the upstream side head unit 17 is supplied to a position above the plane regulating body 9 disposed on the downstream side of the print medium transporting direction while it is pinched by the intermediate roller 19 and the intermediate pressing roller 20. Since a position above the plane regulating body 9 at the downstream side of the print medium transporting direction is a print area disposed under the downstream side had unit 18, printing is performed by discharging ink droplets to the print medium 2 from desired nozzles of the downstream side head unit 18.

In this case, since ink droplets discharged outside the print medium 2 by frameless printing are received in the cleaning unit through the penetration of the plane regulating body 9, ink is not attached to the upper surface of the plane regulating body 9 and the opposite surface of the print surface of the print medium 2. Accordingly, those surfaces are not polluted.

The print medium 2 on which printing is performed by the upstream side head unit 17 and the downstream side head unit 18 slides along the upper surface of the plane regulating body 9 and is supplied to the upper surface of the transporting belt 1. Since opposite polarities of charges are alternately supplied to the transporting belt 1 in the print medium transporting direction, when the print medium 2 is delivered to the upper surface of the transporting belt 1, the print medium 2 is adsorbed to the upper surface of the transporting belt 1 by electrostatic adsorption attributable to the dielectric polarization. In such a state, when the driving roller 3 is rotated by an electric motor (not shown), the rotational driving force is transferred to the driven roller 4 via the transporting belt 1, and therefore the print medium 2 is transported toward the paper discharging portion. After the print medium 2 reaches the paper discharging portion, the print medium 2 is separated from the surface of the transporting belt 1 by a separating device (not shown) and then is discharged to the paper discharging portion.

Figure 3:
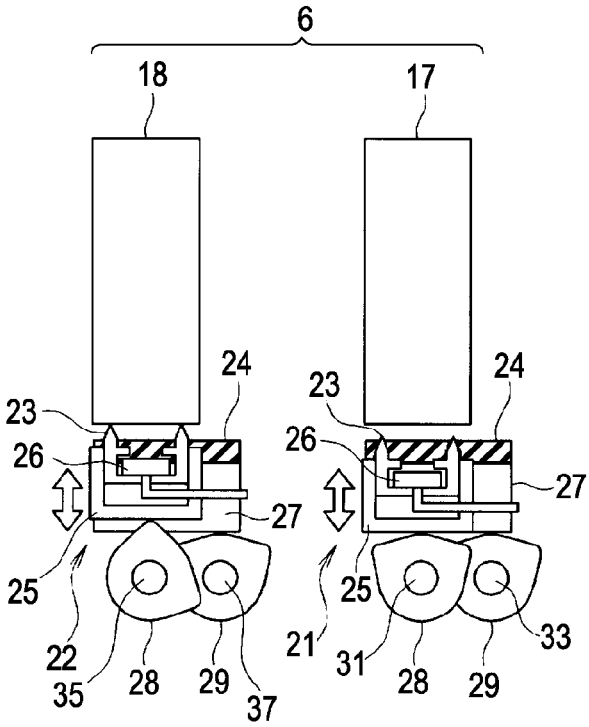
FIG. 3 is a front view illustrating details of a cleaning unit of FIG. 1.

With this embodiment, the upper stream side head unit 17 and the down stream side head unit 18 are provided on the opposite sides of the upstream side cleaning unit 21 and the downstream side cleaning unit 22, respectively with respect to the penetration hole of the plane regulating body 9. As shown in FIG. 3, each of these cleaning units 21 and 22 is equipped with a cap 23 which can stay in close to the nozzle-formed surface of any of the head units 17 and 18 and with a wiper 24 which wipes the nozzle-formed surface of any of the head units 17 and 18 while abutting against the nozzle-formed surface. Each cap 23 has a rectangular shape and is made of rubber. The caps 23 cover the nozzle-formed surfaces of the head units 17 and 18, respectively. Each of the caps 23 is received in a case 25 which also has a rectangular shape. A bottom portion of the cap 23 is provided with an ink absorbing member 26 for absorbing ink. The wiper 26 is a thin plate member made of rubber and is provided to protrude from an upper end portion of a wiper support member 27. Further, all caps 23 are connected to a suction device such as a tube pump (not shown).

A cap-moving cam member 28 and a wiper-moving cam member 29 for moving the cams 23 and the wipers 26, respectively in a vertical direction via the case 25 and the wiper support member 27, respectively are provided under the case 25, which support the cap 23, and the wiper support member 27, respectively. A shape of a cam nose will be described later. The cap-moving cam member 28 of the upstream side cleaning unit 21 is attached to a rotation shaft 31 of an upstream side cap moving motor 30, and the wiper-moving cam member 29 of the upstream side cleaning unit 21 is connected to a rotation shaft 33 of an upstream side wiper-moving motor 32. The cap-moving cam member 28 of the downstream side cleaning unit 22 is attached to a rotation shaft 35 of a downstream side cap moving motor 34, and the wiper-moving cam member 29 of the downstream side cleaning unit 22 is connected to a rotation shaft 37 of a downstream side wiper-moving motor 36.

Figure 4:
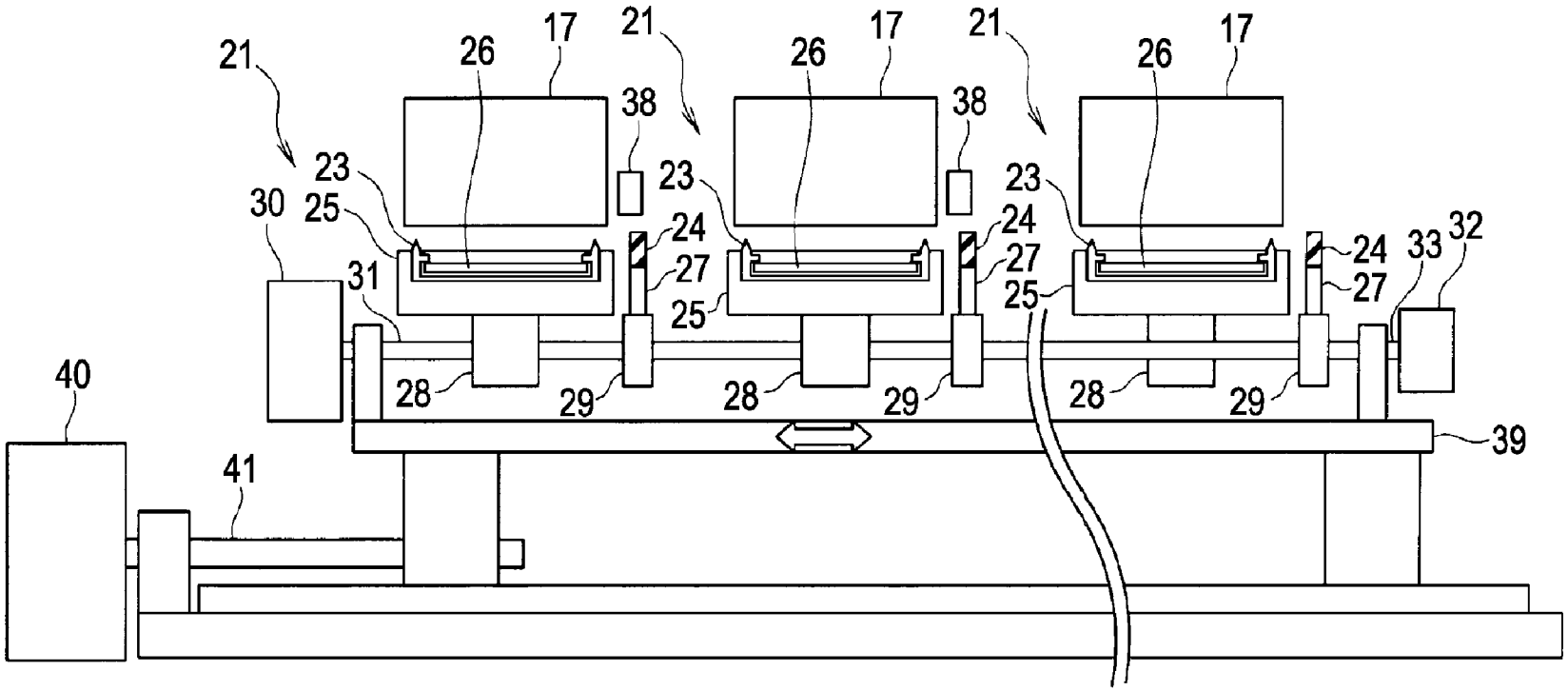
FIG. 4 is a right side view illustrating the cleaning unit of FIG. 3.

As a representative of the attachment structures, FIG. 4 shows an attachment structure for the upstream side cap-moving motor 30 and the upstream side wiper-moving motor 32 and the cam members 28 and 29. Reference numeral 38 denotes the ink absorbing member for absorbing ink which is wiped by the wiper 24 and escapes from the nozzle-formed surface. Both of the upstream side cap-moving motor 30 and the up-stream side wiper-moving motor 32 and the upstream side cleaning units 21 and 22 are provided on large sliding tables 39. A leg of each of sliding tables 39 is provided with a screw hole which engages with a screw provided to a rotation shaft 41 of a sliding motor 40. Accordingly, when the rotation shaft 41 of the sliding motor 40 rotates, the wiper 24 in each of the sliding tables 39 reciprocates in a direction which intersects the print medium transporting direction, i.e. in a direction of an arrow of FIG. 4.

Figure 5:
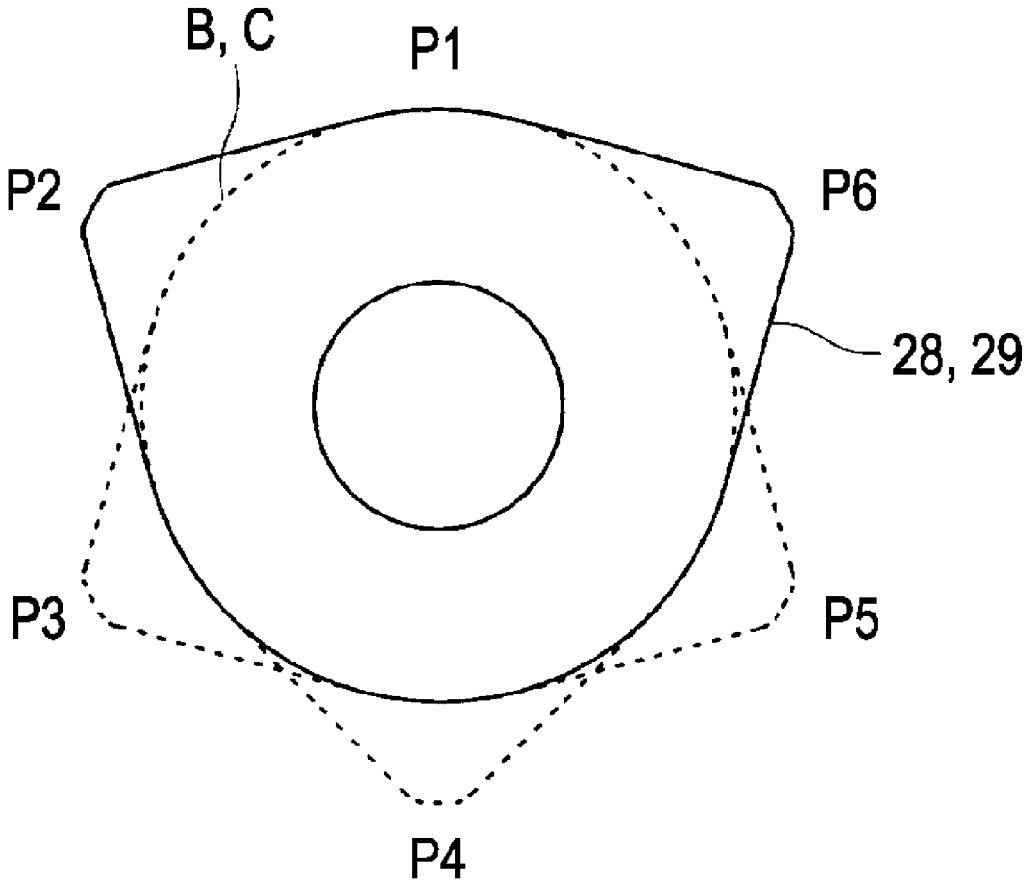
FIG. 5 is an explanatory view illustrating a cam which moves the cleaning unit.

Next, the cam nose provided to each of the cams 28 and 29 will be described. With this embodiment, as shown in FIG. 5, with respect to base circular portions B and C of the cam members 28 and 29, the cam noses are set at every 60° of a rotation angle (phase). For example, as shown in FIG. 1*b*, four upstream side cleaning units 21 are disposed so as to face four upstream side head units 17, respectively, and the cap 23 and the wiper 24 are provided to each of the four upstream side cleaning units 21. Further four cap-moving cam members 28 and four wiper-moving cam members 29 are provided for each of the caps 23 and each of the wipers 24, respectively. In this case, with respect to a first cap-moving cam member 28, cam noses are formed at positions P2 and P6 of FIG. 5, respectively. With respect to a second cap-moving cam member 28, cam noses are formed at positions P3 and P6 of FIG. 5. With respect to a third cap-moving cam member 28, cam noses are formed at positions P4 and P6 of FIG. 5. With respect to a fourth cap-moving cam member 28, cam noses are formed at positions P5 and P6 of FIG. 5. Accordingly, in all of the cap-moving cam members 28 of FIG. 5, a position P1 of each of the cap-moving cam members is not provided with the cam nose. Further, in all of the cap-moving cam members 28, the position P6 of each of the cap-moving cam members 28 of FIG. 5 is provided with the cam nose.

Figure 6:
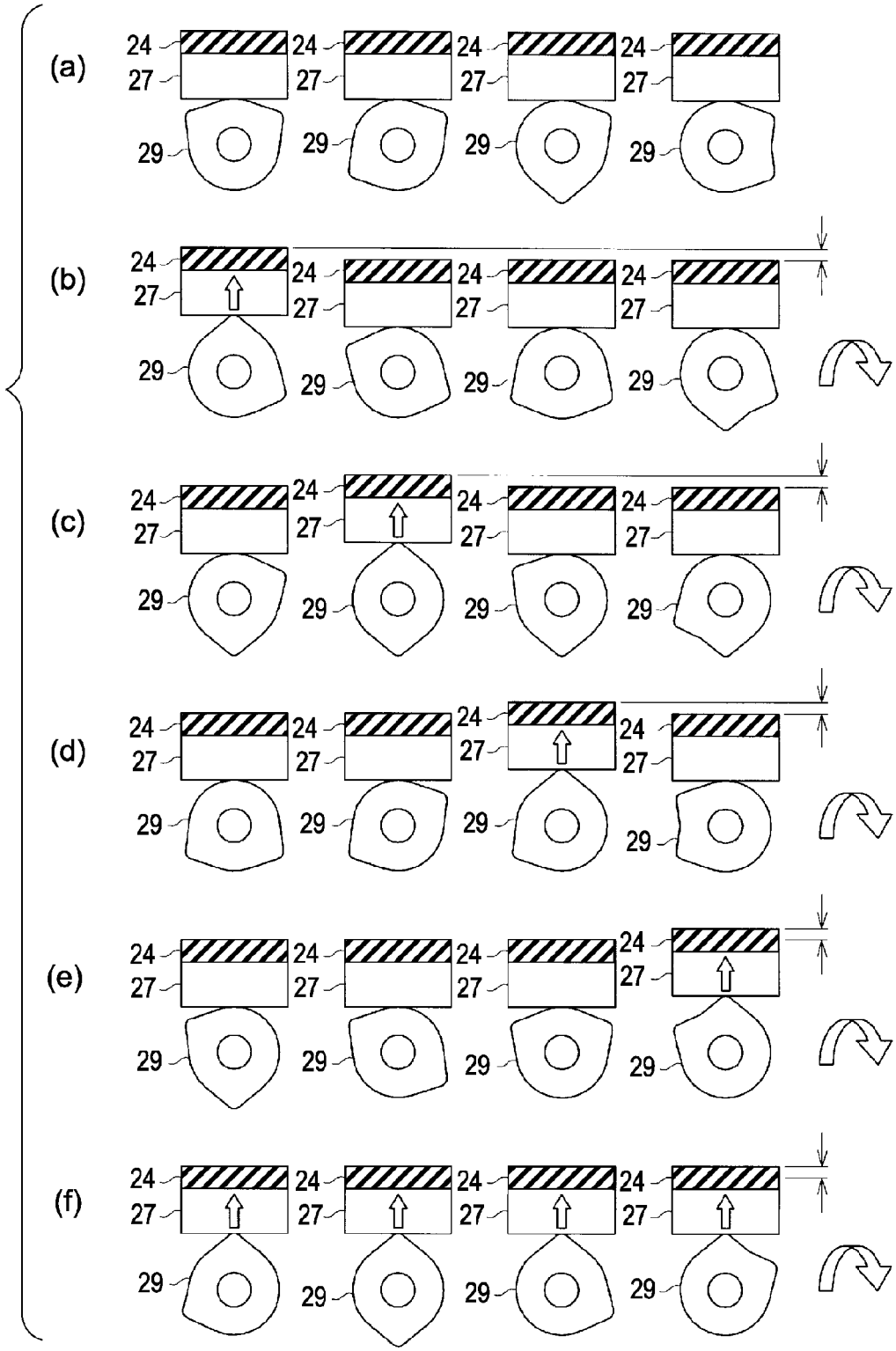
FIG. 6 is an explanatory view for explaining movement of the cleaning unit by the cam of FIG. 5.

FIG. 6 snows that cam noses having the same structure are provided to first to fourth wiper-moving cam members 29. Since the four wiper-moving cam members 29 are attached to the rotation shaft 33 of the upstream side wiper-moving motor 32, the wiper-moving cam members 29 are synchronously rotated.

Accordingly, as shown in FIG. 6*a*, the positions P1 of the first to fourth wiper-moving cam members 29 of FIG. 5 face upward and abut against the wiper support members 27. In such a case, all the wiper support members 27 and the wipers 24 come to face downward. In such a state, since any of the wipers 24 do not protrude toward the print medium transporting line, printing is performed in this state. From this state, as shown in FIG. 6*b*, when the rotation shaft 33 of the upstream side wiper-moving motor 32 is rotated rightward, that is, the rotation shaft 33 of the upstream side wiper moving motor 32 is rotated clockwise by 60°, the positions P2 of the wiper-moving cam members 29 of FIG. 5 move to face upward and come to abut against the wiper support members 27. The positions P2 of FIG. 5 are only provided with the cam nose of the first wiper-moving cam member 29. Accordingly, the leftmost wiper support member 27 of FIG. 6*b* is pushed up by the cam nose of the first wiper-moving cam member 29 and therefore the wiper 24 is raised to a position of the nozzle-formed surface of the first upstream side head unit 17. In the case in which the cam member is the cap-moving cam member 28, the first cap 23 is brought into close contact with the nozzle-formed surface of the first upstream side head unit 17.

From this state, as shown in FIG. 6*c*, when the rotation shaft 33 of the upstream side wiper-moving motor 32 is rotated clockwise by 60°, the positions P3 of the wiper-moving cam members 29 of FIG. 5 become to face upward and abut against the wiper support members 27. Since the positions P3 of FIG. 5 are only provided with the cam nose of the second wiper-moving cam member 29, the second leftmost wiper support member 27 of FIG. 6*c* is pushed up by the cam nose of the second wiper-moving cam member 29. In this case, the wiper 24 is raised to a position of the nozzle-formed surface of the second upstream side head unit 17. In the case in which the cam member is the cap-moving cam member 28, the second cap 23 is brought into close contact with the nozzle-formed surface of the second upstream side head unit 17.

From this state, as shown in FIG. 6*d*, the rotation shaft 33 of the upstream side wiper-moving motor 32 is rotated clockwise by 60°, the positions P4 of the wiper-moving cam members 29 of FIG. 5 become to face upward and abut against the wiper support members 27. Since the positions P4 of FIG. 5 are only provided with the cam nose of the third wiper-moving cam member 29, the second rightmost wiper support 27 of FIG. 6*d* is pushed up by the cam nose of the third wiper-moving cam member 29. In this case, the wiper 24 is raised to a position of the nozzle-formed surface of the third upstream side head unit 17. In the case in which the cam member is the cap-moving cam member 28, the third cap 23 is brought into close contact with the nozzle-formed surface of the third upstream side head unit 17.

From this state, as shown in FIG. 6*e*, the rotation shaft 33 of the upstream side wiper-moving motor 32 is rotated clockwise by 60°, the positions P5 of the wiper-moving cam members 29 of FIG. 5 move to face upward and abut against the wiper support members 27. Since the positions P5 of FIG. 5 are only provided with the cam nose of the fourth wiper-moving cam member 29, the rightmost wiper support member 27 of FIG. 6*e* is pushed up by the fourth wiper-moving cam member 29. In this case, the wiper 24 is raised to a position of the nozzle-formed surface of the fourth upstream side head unit 17. In the case in which the cam member is the cap-moving cam member 28, the fourth cap 23 is in close contact with the nozzle-formed surface of the fourth upstream side head unit 17.

From this state, as shown in FIG. 6*f*, when the rotation shaft 33 of the upstream side wiper-moving motor 32 is rotated clockwise by 60°, the positions P6 of the wiper-moving cam members 29 of FIG. 5 move to face upward and abut against the wiper support member 27. The positions P6 of FIG. 5 are only provided with the cam noses of the wipe-moving cam members 29. Accordingly all the wiper support members 27 of FIG. 6*f* are pushed up by the cam noses of all the wiper-moving cam members 29. In this case, all of the wipers 24 are simultaneously raised to a position of the nozzle-formed surface of the upstream side head unit 17. In the case in which the cam member is the cap-moving cam member 28, all of the caps 23 are simultaneously brought into contact with the nozzle-formed surfaces of all of the upstream side head units 17.

Figure 7:
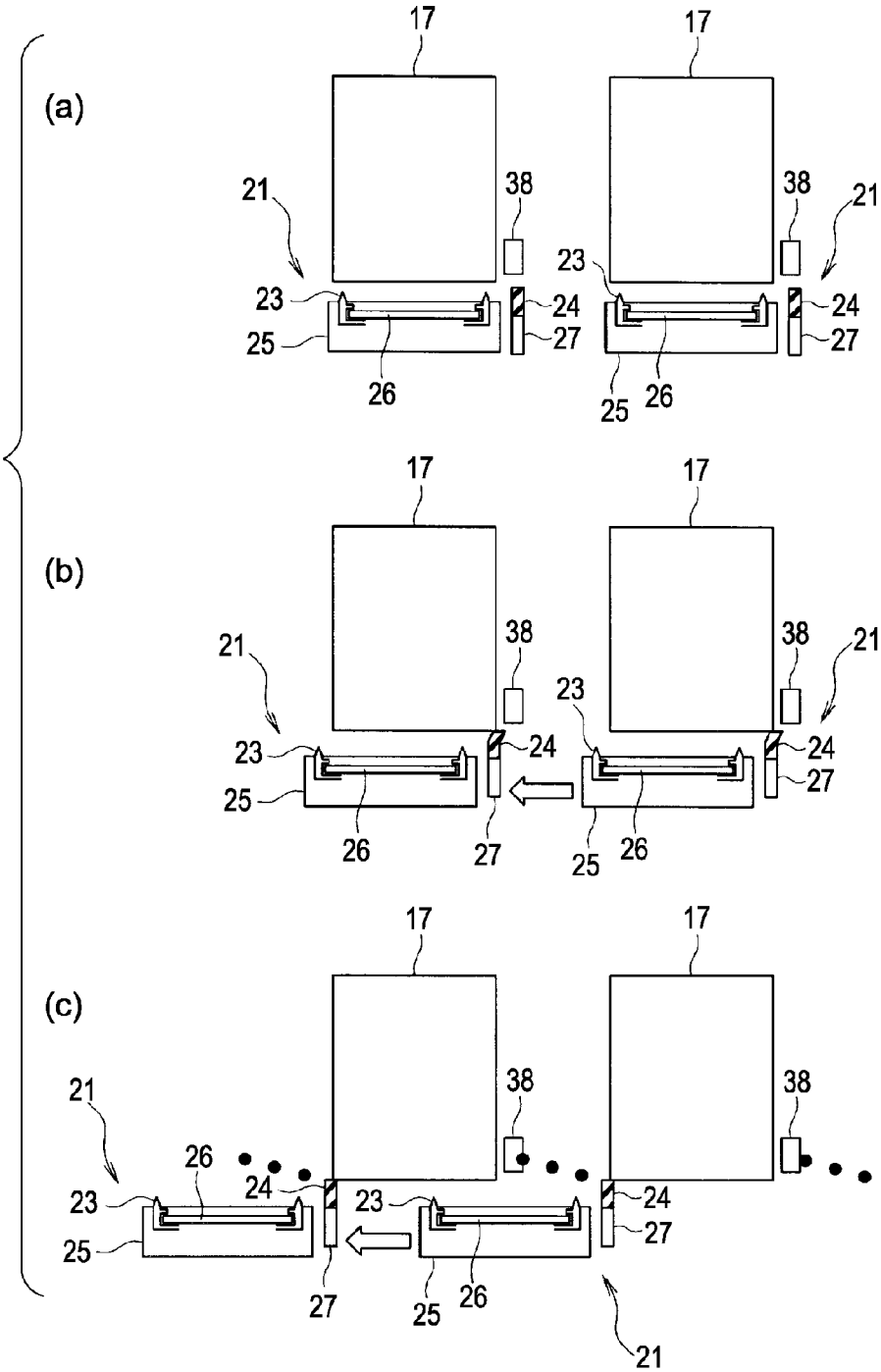
FIG. 7 is an explanatory view for explaining wiping operation by the moving mechanism of FIG. 4.

As shown in FIG. 7*a*, after the wipers 24 are selectively or entirely raised to a position of the nozzle-formed surfaces (that is, all of the wipers 24 are raised in the figure), a rotation shaft 41 of a sliding motor 40 is rotated, as shown in FIG. 7*b*, if the wiper 24 are moved in a direction which intersects the print medium transporting direction (i.e. the direction of an arrow of the figure) for every sliding table 39, the wiper 24 abutting against the nozzle-formed surface of the upstream side head unit 17 wipes the nozzle-formed surface of the corresponding head unit 17. Further, the wiper 24 elastically deforms when the wiper 24 wipes the nozzle-formed surface. In this manner, after the nozzle-formed surface of the upstream side head unit 17 is wiped off, rotation of the rotation shaft 41 of the sliding motor 40 is stopped, and the wiper 24 is stopped to move as shown in FIG. 7*c* for every sliding table 39. When the wiper 24 is recovered by itself by elasticity, ink attached to the wiper 24 flies off in a direction of recovery of the wiper 24 along the wiping operation. However, with this embodiment, since the ink absorbing member 38 is arranged in an ink flying direction and the ink which is trying to fly is absorbed to the ink absorbing member 38, it is possible to suppress pollution of the printing apparatus which is attributable to the fly of ink.

Further, in the state in which the cap 23 is in close contact with the nozzle-formed surface of the upstream side head unit 17, if inside pressure of the cap 23 is reduced by a suction device, such as a tube pump (not shown), the ink in the nozzle is sucked in and therefore nozzle trouble is resolved. Even in the case in which the cap 23 is not in close contact with the nozzle-formed surface of the upstream side head unit 17, it is possible to resolve the nozzle trouble by idle spitting the ink from the nozzles of the upstream side head unit 17 in a state in which the cap 23 is under the upstream side head unit 17. The former resolution of the nozzle trouble is applied to relatively severe nozzle trouble, such as nozzle clogging and is called cleaning. The latter resolution of the nozzle trouble is applied to relatively light nozzle trouble, such as attachment of paper powder or dust and the increase in ink viscosity, and is called flushing. Cleaning of the nozzle-formed surface by the wiper 24 is called wiping. The cap 23 is brought into close contact with the nozzle-formed surface of the upstream side head unit 17 and therefore it is possible to prevent the ink in the nozzles from being dried. This method is called capping. Resolution of nozzle trouble, wiping, and capping are performed with respect to the downstream side head unit 18.

Figure 8:
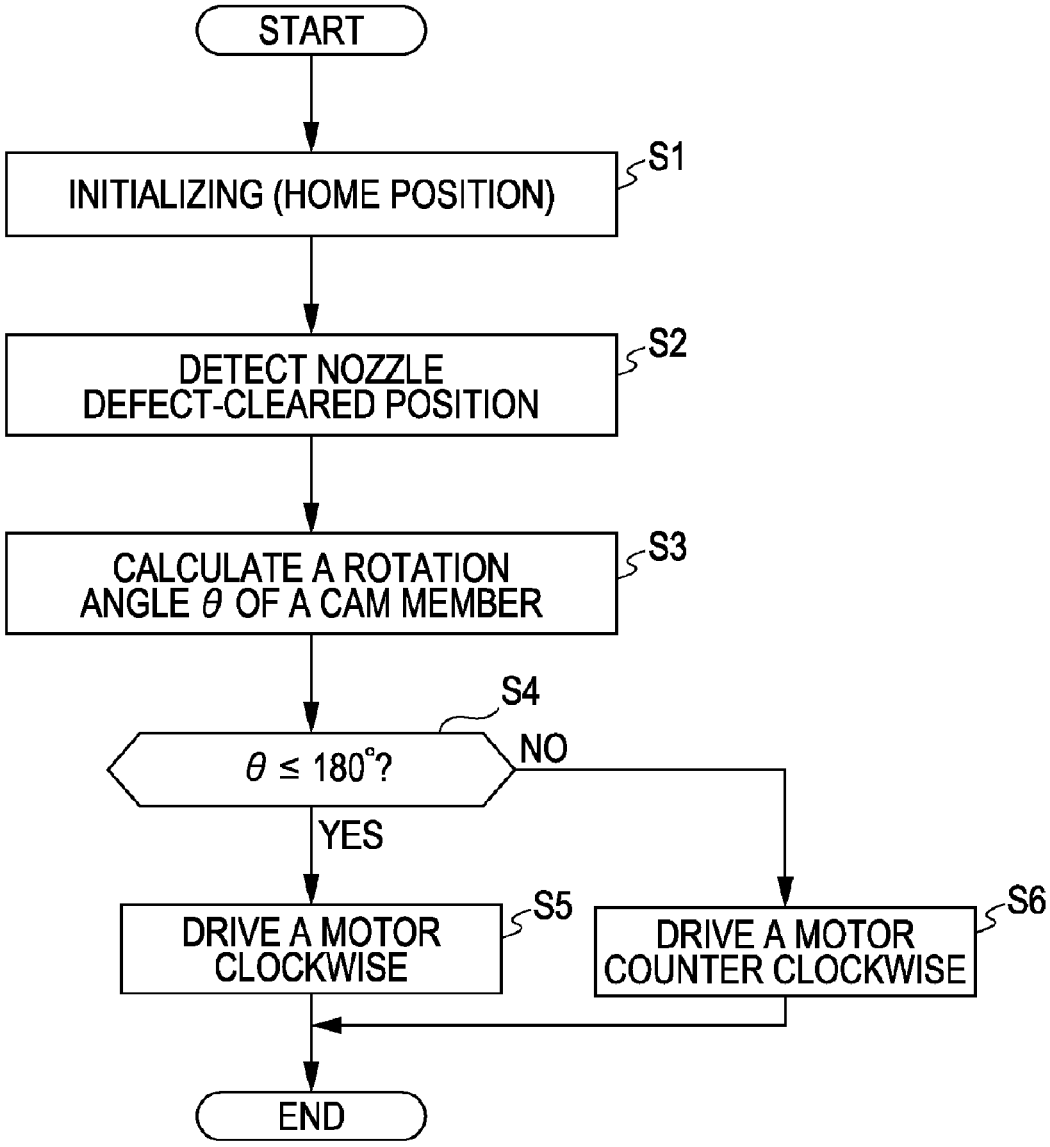
FIG. 8 is a flowchart illustrating arithmetic processing for moving the cleaning unit for recovering nozzles.

It is known that the cause or state of the nozzle trouble can be determined from the state of residual vibration which is vibration remaining after the piezo-electric element is driven in the case in which an ink droplet discharge actuator is a piezo-electric element. FIG. 8 shows arithmetic processing for detecting a position of a head unit of which nozzle trouble must be resolved, for making the cap 23 stay close the head unit, and for making the wiper 24 abut against the head unit. The arithmetic processing is performed in a control device. First, at Step S1, cleaning units 21 and 22 are initialized. That is, the cleaning units 21 and 22 are returned to a home position.

Next, at Step S2, a position at which nozzle trouble is resolved (nozzle trouble resolved position) is detected.

Next, at Step S3, a rotation angle θ of the cam member is calculated from the nozzle trouble resolved position detected at Step S2.

Next, at Step S4, it is determined whether the rotation angle θ of the cam member calculated at Step S3 is 180° or smaller. In the case in which the rotation angle θ of the cam member is 180° or smaller, Step S5 is performed. However, in the case in which the rotation angle is larger than 180°, Step S6 is performed.

At step S5, each motor is driven clockwise up to the rotation angle θ to drive the cam member, and the processing step is returned to a main program.

At step S6, each motor is driven counterclockwise up to the rotation angle θ to drive the cam member, and the processing step is returned to the main program.

According to this arithmetic processing, the nozzle trouble resolved position is detected, the rotation angle θ of the cam member depending on the nozzle trouble resolved position is calculated, the motor is rotated clockwise when the rotation angle is 180° or smaller, and the motor is rotated counterclockwise when the rotation angle is larger than 180°. As a result, the cap can be more rapidly brought into contact with the nozzle-formed surface of the head unit and the wiper can abut against the nozzle-formed surface of the head unit.

Figure 9:
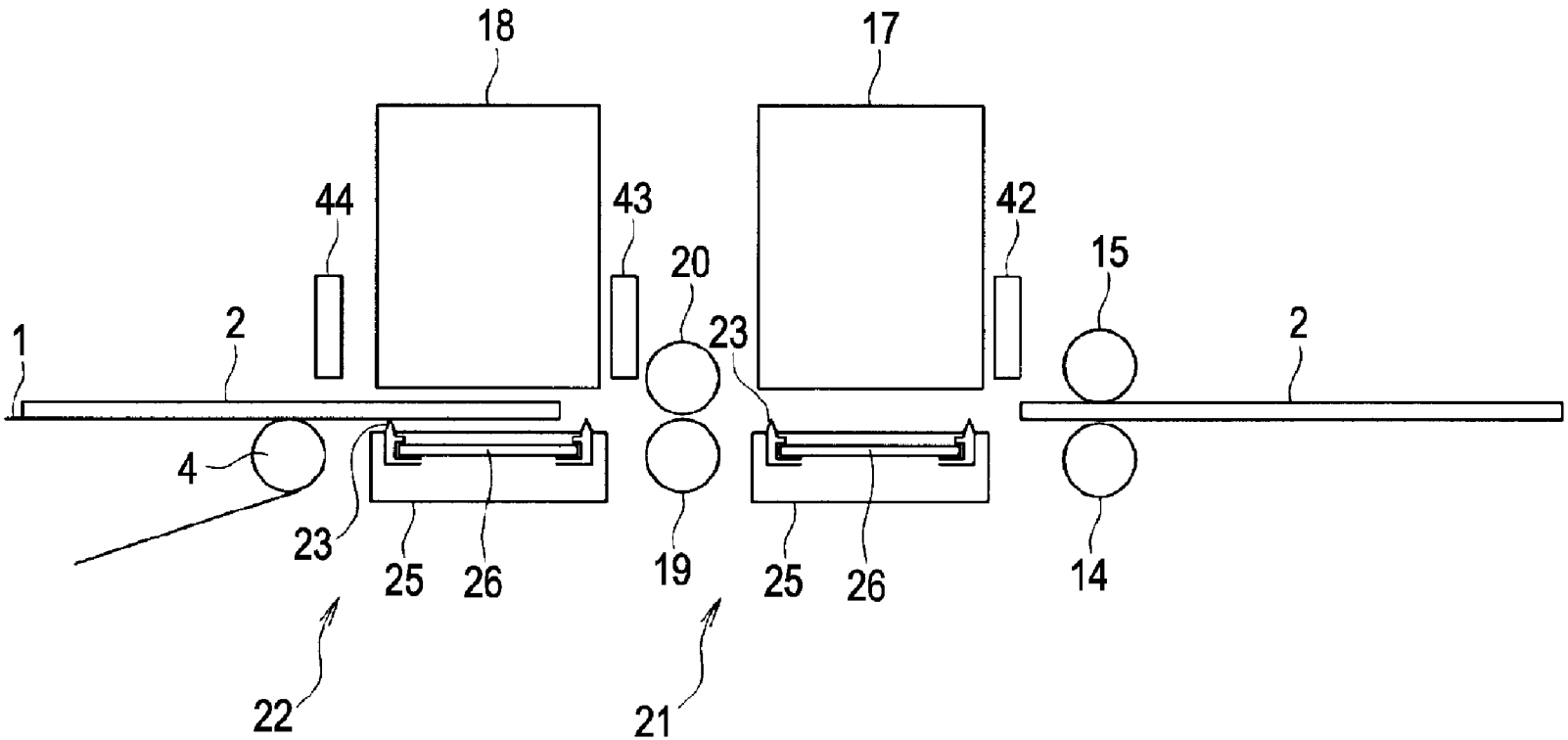
FIG. 9 is an explanatory view for explaining flushing operation in the ink-jet printer of FIG. 1.
Figure 10:
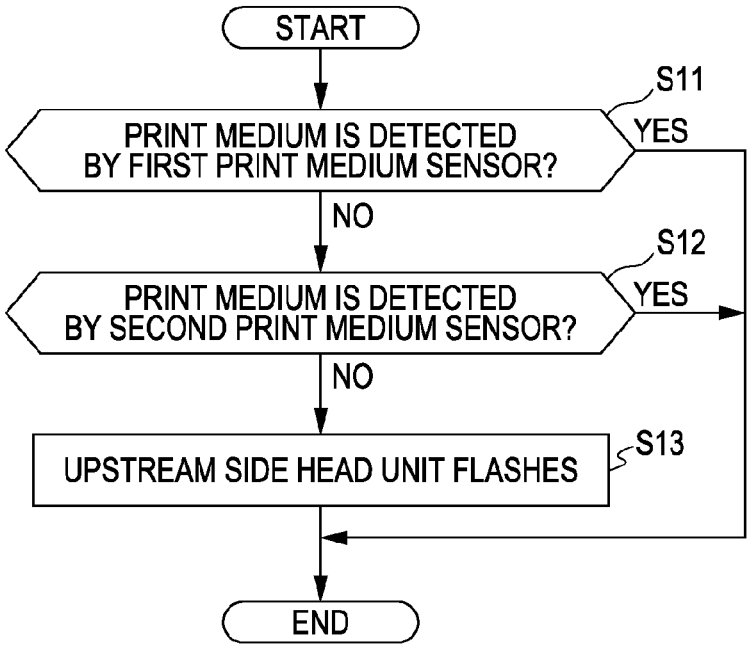
FIG. 10 is a flowchart illustrating arithmetic processing for flushing an upstream side head unit of FIG. 1.

Additionally, cleaning, wiping, or capping is performed during a non-printing period but only flushing can be performed without moving the cleaning units 21 and 22. FIG. 9 shows condition for performing flushing of the upstream side head unit 17 at a midway position between a previous print medium 2 and a next print medium 2, in which a plane regulating body is not shown. In greater detail, when the print medium 2 does not exist under the upstream side head unit 17, the flushing can be performed. FIG. 10 shows arithmetic processing for flushing the upstream side head unit 17. In this arithmetic processing, fir at Step S11, it is determined whether the print medium 2 exists under a first print medium sensor 42. In the case in which the print medium 2 is present under the first print medium sensor 42, the processing step is returned to the main program. Conversely, in the case in which the print medium 2 is not present under the first print medium sensor 42, Step S12 is performed.

At Step S12, it is determined whether the print medium 2 exists under a second print medium sensor 43. In the case in which the print medium 2 is present under the second print medium sensor 43, the main program is executed. Conversely, in the case in which the print medium 2 is not present under the second print medium sensor 43, Step S13 is performed.

At Step S13, the upstream side head unit 17 is flushed and then the main program is executed.

Figure 11:
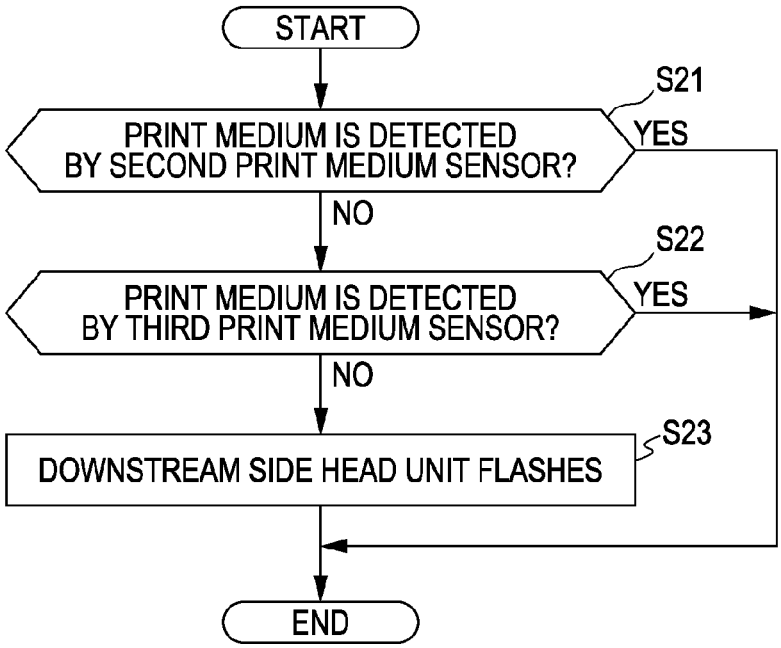
FIG. 11 is a flowchart illustrating arithmetic processing for flushing a downstream side head unit of FIG. 1.

FIG. 11 shows arithmetic processing for flushing the downstream side head unit 18. In the arithmetic processing, first at Step S21, it is determined whether the print medium 2 exists under the second print medium sensor 43. In the case in which the print medium 2 is present under the second print medium sensor 43, the main program is executed. Conversely, in the case in which the print medium 2 is not present under the second print medium sensor 43, Step S22 is performed.

At, Step S22, it is determined whether the print medium 2 exists under a third print medium sensor 44. In the case in which the print medium 2 is present under the third print medium sensor 44, the main program is executed. Conversely, in the case in which the print medium 2 is not present under the third print medium sensor 44, Step S23 is performed.

At Step S23, flushing of the downstream side head unit 18 is performed and then the main program is executed.

According to the ink-jet printer of the embodiment, ink-jet (liquid ejecting) head 6 for ejecting ink (liquid) from nozzles to the entire area of the print medium 2 which is transported in a direction which intersects the print medium transporting direction is provided. The ink-jet printer further includes a plurality of head units 17 and 18 divisionally provided in a direction which intersects a print medium transporting direction, a plurality of cleaning unit 21 and 22 provided to face the plurality of head units 17 and 18, respectively with a transportation line of the print medium between themselves and the plurality of head units 17 and 18, and a moving unit which selectively moves at least one cleaning unit of the plurality of cleaning units 21 and 22 so as to stay in close contact with the head unit 17 or 18 which faces the selected cleaning unit. For this instance, only cleaning units 21 and 22 which face the head units 17 and 18 of which the nozzles are required to be recovered are selected. In such a manner, ink is sucked in (cleaning operation) from the nozzles of the corresponding head unit 17 or 18. Therefore, it is possible to suppress wasteful use of ink.

The cleaning units 21 and 22 are provided with wipers 24 which wipe the nozzle-formed surfaces of the head units 17 and 18 that the wipers 24 face the cleaning units 21 and 22, respectively. The ink-jet printer further includes a second moving unit which moves the wipers 24 along the nozzle-formed surfaces of the head units 17 and 18 while the wipers 24 abut against the nozzle-formed surface of the corresponding head units 17 and 18. Since only the cleaning units 21 and 22 which faces the head units 17 and 18 of which the nozzle-formed surfaces are required to be recovered are selected, the wipers 24 are brought into contact with the nozzle-formed surfaces of only the selected head units 17 and 18, and only the nozzle-formed surfaces of such head units 17 and 18 are recovered (wiping operation), it is possible to prevent the nozzle-formed surfaces which do not need recovering from deteriorating.

The cleaning units 21 and 22 are provided with caps 23 which cover the nozzle-formed surfaces of the corresponding head units 17 and 18 which face the caps 23 and with ink suction units which suck in ink from nozzles from the corresponding head units 17 and 18 while the caps 23 are in close contact with the nozzle-formed surfaces of the corresponding to head units 17 and 18. With such a structure, since only the cleaning units 21 and 22 which face the head units 17 and 18 of which nozzle-formed surfaces need recovering are selected, the caps 23 are brought into contact with the nozzle-formed surfaces of such head units 17 and 18, and ink is sucked in from nozzles of such head units 17 and 18, it is possible to suppress wasteful expenditure of ink. Further, since the caps 23 of the cleaning units 21 and 22 are in close contact with the nozzle-formed surfaces of the head units 17 and 18 while the head units 17 and 18 are not in use, it is possible to prevent ink in the nozzles of the head units 17 and 18 from being dried (capping operation).

As the moving unit, the ink-jet printer includes cam members 28 and 29 provided corresponding to the plurality of cleaning units 21 and 22. A plurality of cam members 28 and 29 is attached to a rotations haft of a single motor. Accordingly, it is possible to selectively move at least one of the cleaning units 21 and 22 abutting against the cam members 28 and 29 by differently setting phases of cam noses of the cam members 28 and 29 attached to the rotations haft of the single motor, it is possible to bring the selected cleaning units 21 and 22 into contact with the nozzle-formed surfaces of the corresponding head units 17 and 18. If it is required, the plurality of cleaning units 21 and 22 can be synchronously moved to be in close contact with the nozzle-formed surfaces of the corresponding head units 17 and 18. Accordingly, it is possible to reduce the total number of the actuators (motors).

By the setting in which the phases of the cam noses of the cam members 28 and 29 attached to the rotation shaft of the single motor are different, any one or plural cleaning units 21 and 22 can be selectively moved so as to be in close contact with the nozzle-formed surfaces of the corresponding head units 17 and 18.

The Best Embodiment

The invention can be used in the following embodiment.

In greater detail, on the transporting belt 1, the print medium 2 is transported in a manner such that the center position of the transporting belt 1 in a direction of a width of the transporting belt 1 (the width means a width in a direction perpendicular to a direction of transportation of the transporting belt 1) is at the center of the print medium 2.

In such a case, a plurality of liquid ejecting head unit groups placed above the transporting belt 1 is placed so that a center position thereof corresponds the center position of the transporting belt 1 like the print medium 2 (see FIG. 1B).

Here, description will be made with reference to FIG. 1*b*. In the printing apparatus of the invention, the width of the print medium 2 is set to response to widths of various kinds of print media and to be symmetric with respect to the above-mentioned center position. Thanks to such setting, a certain print medium is used, in the case in which all of liquid ejecting head units corresponding to three head units 18 connected to the rotation shaft 35 are used for printing, and two liquid ejecting head units corresponding to two head units 17 of four head units 17 connected to the rotation shaft 31 which are placed on the inner side with respect to the widthwise direction of the transporting belt 1 may be used for printing. In such a case, it is determined that which size (width) of print medium is to be transported by the print medium detecting unit of the printing apparatus before printing, and then the printing operation is performed. After that, in the case of performing cleaning using the cleaning unit, predetermined operations are performed with respect to the actuators 34 and 36 on the basis of the information from the print medium detecting unit. Accordingly, it is possible to selectively clean only the liquid ejecting head unit used for the printing operation.

In greater detail, in the case of FIG. 1*b*, there are three liquid ejecting head units corresponding to three head units 18 connected to the rotation shaft 35 and therefore there are seven operation patterns by which at least a certain cleaning unit is operated. Since the cleaning units are not operated (that is, the cleaning units are not in contact with the liquid ejecting heads) in the middle of printing operation, the number of patterns by which three cleaning units is one. It is preferable that shapes of the cap-moving cam members 28 and the wiper-moving cam members 29 are determined so as to be able to realize the total eight patterns. In such a case, the rotation shaft 31 and 33 may have eight patterns formed by presence and absence of the cam nose. Further, in such a case, each of the rotation shafts 31 and 33 is rotated by an angle of 40°.

In this manner, it is possible to drive only randomly selected cleaning units in response to the width of the print medium.

The selective driving of the cleaning units may not be limited to the above-described embodiment. That is, there are other selective driving methods of the cleaning units. For example, in the case in which printing operation is performed on the basis of width information of print data which is information about the width of print media and the cleaning is performed using the cleaning units, the actuators 34 and 36 are driven in a predetermined manner on the basis of the width information of the print media. Only the liquid ejecting head units used in the printing operation may be selectively cleaned in such a manner.

The print medium 2 may be placed using the end position of the transporting belt 1 as the reference position.

What is claimed is:

1. A printing apparatus comprising:

a plurality of liquid ejecting head units divisionally disposed in a direction which intersects a print medium transporting direction;

a plurality of cleaning units disposed so as to face the plurality of liquid ejecting head units; and a first moving unit configured to select one or more cleaning units comprising fewer than all of the plurality of cleaning units and to make the selected cleaning units stay close to the one or more liquid ejecting head units which face the selected one or more cleaning units.

2. The printing apparatus according to claim 1, wherein the cleaning unit is equipped with a wiper which wipes a nozzle-formed surface of the liquid ejecting head unit which faces the corresponding cleaning unit, and the printing apparatus further comprises a second moving unit which moves the wiper along the nozzle-formed surface in a state in which the wiper is in contact with the nozzle-formed surface of the liquid ejecting head unit which faces the corresponding cleaning unit.

3. The printing apparatus according to claim 1, wherein each of the cleaning units is equipped with a cap which covers the nozzle-formed surface of the liquid ejecting head unit which faces the corresponding cleaning unit, and the printing apparatus further comprises a suction unit which sucks in liquid in and around nozzles of the liquid ejecting head unit in a state in which the caps are in contact with the nozzle-formed surfaces of the liquid ejecting head units which face the corresponding cleaning units.

4. The printing apparatus according to claim 1, wherein the first moving unit includes a plurality of cams disposed corresponding to the plurality of cleaning units, and the plurality of cams are attached to a rotation shaft of a single actuator.

5. The printing apparatus according to claim 4, wherein phases of cam noses of the plurality of cams attached to the rotation shaft of the single actuator are different from one another.

6. The printing apparatus according to claim 1, the first moving unit being further configured to select all of the plurality of cleaning units and to make all of the plurality of cleaning units stay close to the plurality of liquid ejecting head units.

7. A printing apparatus comprising:

a plurality of liquid ejecting head units divisionally disposed in a direction which intersects a print medium transporting direction;

a plurality of cleaning units disposed so as to face the plurality of liquid ejecting head units; and a moving unit which selects at least one cleaning unit of the plurality of cleaning units and makes the selected cleaning unit stay in close contact with the liquid ejecting unit which faces the corresponding cleaning unit, wherein the moving unit operates so as to move only the plurality of cleaning units corresponding to a width of the print medium on the basis of information about the width of the print medium.

* * * * *